US008809720B2

(12) United States Patent
Ham

(10) Patent No.: US 8,809,720 B2
(45) Date of Patent: Aug. 19, 2014

(54) ARC EXTINGUISHING MECHANISM FOR MOLD CASED CIRCUIT BREAKER

(75) Inventor: Seung Jin Ham, Chungcheongbuk-Do (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 579 days.

(21) Appl. No.: 13/168,776

(22) Filed: Jun. 24, 2011

(65) Prior Publication Data

US 2012/0006791 A1 Jan. 12, 2012

(30) Foreign Application Priority Data

Jul. 6, 2010 (KR) ..... 10-2010-0065072

(51) Int. Cl.
*H01H 9/36* (2006.01)

(52) U.S. Cl.
CPC ..... *H01H 9/362* (2013.01); *H01H 2009/365* (2013.01)
USPC ..... 218/46; 218/156; 218/151

(58) Field of Classification Search
CPC ..... H01H 9/30; H01H 9/34; H01H 9/36
USPC ..... 218/34, 35, 38, 149–151, 156–158; 335/201, 202
See application file for complete search history.

(56) References Cited

U.S. PATENT DOCUMENTS 3,440,378 A * 4/1969 Baird ..... 218/34
4,877,929 A * 10/1989 Rival ..... 218/20
5,756,951 A * 5/1998 Manthe et al. ..... 218/35
7,202,436 B1 * 4/2007 Zindler ..... 218/149
2005/0263492 A1 * 12/2005 McCoy ..... 218/34

FOREIGN PATENT DOCUMENTS

| | | |
|---|---|---|
| CN | 1445802 A | 10/2003 |
| DE | 8903583 | 5/1989 |
| EP | 0299460 | 1/1989 |
| EP | 1463075 | 9/2004 |
| EP | 1923897 | 5/2008 |
| KR | 20-0437071 | 11/2007 |

OTHER PUBLICATIONS

State Intellectual Property Office of the People's Republic of China Application Serial No. 201110193696.0, Office Action dated Jul. 3, 2011, 5 pages.
The State Intellectual Property Office of the People's Republic of China Application Serial No. 201110193696.0, Office Action dated Feb. 28, 2014, 5 pages.

* cited by examiner

*Primary Examiner* — Amy Cohen Johnson
*Assistant Examiner* — Marina Fishman
(74) *Attorney, Agent, or Firm* — Lee, Hong, Degerman, Kang & Waimey

(57) ABSTRACT

An arc extinguishing mechanism for the mold cased circuit breaker comprises a plurality of arc grids stacked on one another in a perpendicular direction and supporting plates for supporting the arc grids, and each of the arc grids comprises a U-shaped plate portion made of a ferromagnetic material, and having two leg portions, a plurality of supporting protrusions laterally extending from the U-shaped plate portion to be flush with the U-shaped plate portion, thus to allow the U-shaped plate portion to be coupled to the supporting plates for support, and bent portions extending from the leg portions, respectively, by being bent in a perpendicular direction, to minimize an air gap between the adjacent arc grids stacked on each other so as to increase a force of inducing arc generated in the arc chamber toward the arc grids.

3 Claims, 2 Drawing Sheets

ARC EXTINGUISHING MECHANISM FOR MOLD CASED CIRCUIT BREAKER

CROSS-REFERENCE TO RELATED APPLICATION

This application claims the benefit of earlier filing date and right of priority to Korean Patent Application No. 10-2010-0065072, filed on Jul. 6, 2010, the contents of which is hereby incorporated by reference herein in its entirety.

BACKGROUND OF THE INVENTION

1. Field of the Invention

This specification relates to a mold cased circuit breaker, and particularly, to an arc extinguishing mechanism for a mold cased circuit breaker.

2. Background of the Invention

In a low-voltage electric power system, a mold cased circuit breaker functions to protect an electric load and facilities from a fault current, which is several tens percent to several hundred percent larger than a rated current. The fault current generally includes an over-current and a short-circuit current. When such fault current flows over a reference value, the circuit breaker opens a circuit. Especially, when the short-circuit current flows on a circuit, the short-circuit current, which is conservatively several hundred ampere to several ten thousands ampere, flows on the circuit depending on facility capacities. At this moment, the mold cased circuit breaker works to open (break) the circuit. When the mold cased circuit breaker works due to such short-circuit current, contacts (i.e., movable contact and stationary contact) within the mold cased circuit breaker are separated as soon as the circuit is open, and arc is generated between the contacts. The generated arc is still present for several ms (milliseconds) between the contacts even after a complete separation between the contacts. The arc contains heat and pressure, which may cause mechanical damages of the mold cased circuit breaker. Such mechanical damages are linked directly with operator's safety who carries out installation and maintenance of electric power lines.

An operation time of the mold cased circuit breaker, namely, a time for which the contacts are mechanically separated, is about 2~3 ms, and a time taken until arc extinguishing after arc is generated is about 5 ms to 10 ms. Hence, a time, which may be needed to break a short-circuit current in the mold cased circuit breaker, may be expressed by the sum of the mechanical operation time of the mold cased circuit breaker and the time taken until the arc is extinguished. Accordingly, if the arc is fast extinguished, the short-circuit breaking time of the mold cased circuit breaker may be reduced, which may result in remarkable reduction of electrical/mechanical damages on the mold cased circuit breaker.

So, many studies on reduction of the mechanical operation time and fast arc extinguishing algorithm have been actively conducted to minimize the mechanical/electrical damages on the circuit breaker due to such short-circuit current. Especially, various researches are being conducted, such as an internal structure of a mold cased circuit breaker, in which arc grids are installed at front of contacts for fast arc extinguishing so as to increase an arc voltage and a flow speed and thusly arc is efficiently extinguished, a material which is tolerable to arc heat, and the like.

As a representative device, which is generally used for extinguishing arc, an arc chamber as an assembly of a plurality of arc grids is widely used. Also, in order to improve a driving force (i.e., improve an exhaust speed) with respect to the generated arc, it is necessary to optimize a shape of grid in consideration of an electromagnetic affection.

Hereinafter, description will be given of an example of a related art arc-extinguishing mechanism for a mold cased circuit breaker with reference to FIGS. 1 to 3.

As illustrated in FIG. 1, an arc-extinguishing mechanism for a mold cased circuit breaker according to the related art may include an arc extinguishing mechanism assembly 100. The arc-extinguishing mechanism assembly 100 may include a plurality of arc grids 10 stacked on one another, and a pair of supporting plates 20 for supporting the plurality of arc grids 10. Referring to FIG. 2, each arc grid 10 may include a plate portion 10*a* in a shape like an alphabet "U," made of ferromagnetic substance, and supporting protrusions 10*b* extending from both sides of the corresponding plate portion 10*a*. Each of the supporting plates 20 may include a plurality of grid insertion holes (reference numeral not given), in which the supporting protrusions 10*b* of the arc grids 10 are inserted, respectively. FIG. 1 shows that the supporting protrusions 10*b* of the arc grids 10 are inserted in the corresponding grid insertion holes.

The arc extinguishing mechanism assembly 100, as shown in FIG. 1, is installed that that contacts 40*a* and 30*a* of a stationary contactor 40 and a movable contactor 30 are located between both leg portions of the plate portions 10*a*. Accordingly, the stationary contact 40*a* of the stationary contactor 40 is fixed between both the leg portions of the plurality of plate portions 10*a* of the arc extinguishing mechanism assembly 100, and the movable contact 30*a* of the movable contactor 30 is located between both the leg portions of the plurality of plate portions 10*a* to be movable to a position of contacting the stationary contact 40*a* of the stationary contact 40 or to a position of being separated from the stationary contact 40*a* of the stationary contact 40.

In the meantime, the arc extinguishing mechanism for the mold cased circuit breaker according to the related art was simulated, using an electromagnetic field interpretation simulation program, to check Lorentz force, which is applied to an arc column by the arc grids 10 made of the ferromagnetic material in a direction toward the arc grids 10 under assumption that a direct current 10000 A (Ampere) flows on the arc column.

Such Lorentz force may be expressed by the following Equation (1).

$$F_z = B_x l_y L \tag{1}$$

In Equation (1), Fz denotes Lorentz force, which is applied to the arc column by the arc grids 10 made of the ferromagnetic material shown in FIG. 1 in a direction toward the arc grids 10, Bx denotes amount of magnetic flux formed by the arc column, ly denotes a current of the arc column, L denotes a distance (opening distance) between the movable contact 30*a* and the stationary contact 40*a* at the moment of an opening operation, by which the movable contact 30*a* and the stationary contact 40*a* are separated from each other.

According to the simulation results by the simulation program based on Equation (1), it can be noticed that the arc column, which is under assumption that the direct current 10000 A flows thereon, is affected by Lorentz force of about 120 N (Newton) in a direction toward the arc grids 10.

That is, in the arc extinguishing mechanism for the related art mold cased circuit breaker, the arc column is moved toward the arc grids 10 by about 120 N. In order to further reduce an arc extinguishing time by reduction of an arc movement time, a stronger force should be applied to move the arc column.

SUMMARY OF THE INVENTION

Therefore, an aspect of the detailed description is to provide an arc extinguishing mechanism for a mold cased circuit breaker capable of more fast extinguishing arc column, generated in the arc extinguishing mechanism, by applying Lorentz force stronger than that in the related art.

To achieve these and other advantages and in accordance with the purpose of this specification, as embodied and broadly described herein, there is provided an arc extinguishing mechanism for a mold cased circuit breaker comprising a plurality of arc grids stacked on one another in a perpendicular direction and supporting plates for supporting the arc grids, thus to form an arc chamber, wherein each of the arc grids comprising:

a U-shaped plate portion made of a ferromagnetic materials, and having two leg portions;

a plurality of supporting protrusions laterally extending from the plate portion to be flush with the plate portion, thus to allow the U-shaped plate portion to be coupled to the supporting plates for support; and bent portions extending from the leg portions, respectively, by being bent in a perpendicular direction, to minimize an air gap between the adjacent arc grids stacked on each other so as to increase a force of inducing arc generated in the arc chamber toward the arc grids.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate preferred embodiments and together with the description serve to explain the principles of the invention.

In the drawings.

DETAILED DESCRIPTION OF THE INVENTION

Description will now be given in detail of the preferred embodiment, with reference to the accompanying drawings. For the sake of brief description with reference to the drawings, the same or equivalent components will be provided with the same reference numbers, and description thereof will not be repeated.

Hereinafter, description will be given of a configuration of an arc extinguishing mechanism for a mold cased circuit breaker according to one preferred embodiment.

An arc extinguishing mechanism for a mold cased circuit breaker according to the one preferred embodiment may comprise an arc extinguishing mechanism assembly 100, which comprises a plurality of arc grids 10 stacked in a perpendicular direction to form an arc chamber, and a pair of supporting plates 20 for supporting the arc grids 10.

Figure 4:
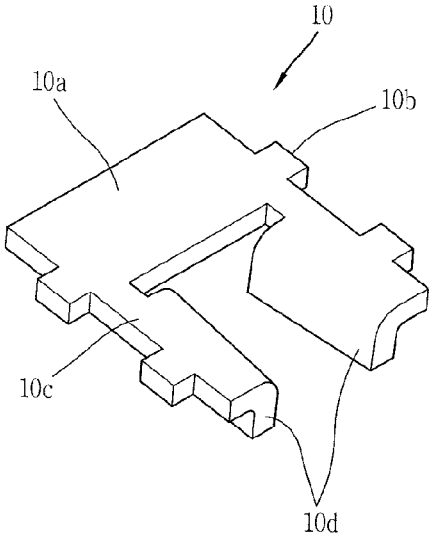
FIG. 4 is a perspective view showing arc grids of the arc extinguishing mechanism for the mold cased circuit breaker.

Referring to FIG. 4, each of the arc grids 10 may comprise a U-shaped plate portion 10*a* having two leg portions 10*c*, a plurality of supporting protrusions 10*b*, and bent portions 10*d*.

The U-shaped plate portion 10*a* may be made of a ferromagnetic material, and have the two leg portions 10*c*.

The plurality of supporting protrusions 10*b* may extend from both sides of the U-shaped plate portion 10*a* to be flush with the U-shaped plate portion 10*a*, thus to allow the U-shaped plate portion 10*a* to be coupled to the supporting plate portions 20 for support.

Figure 1:
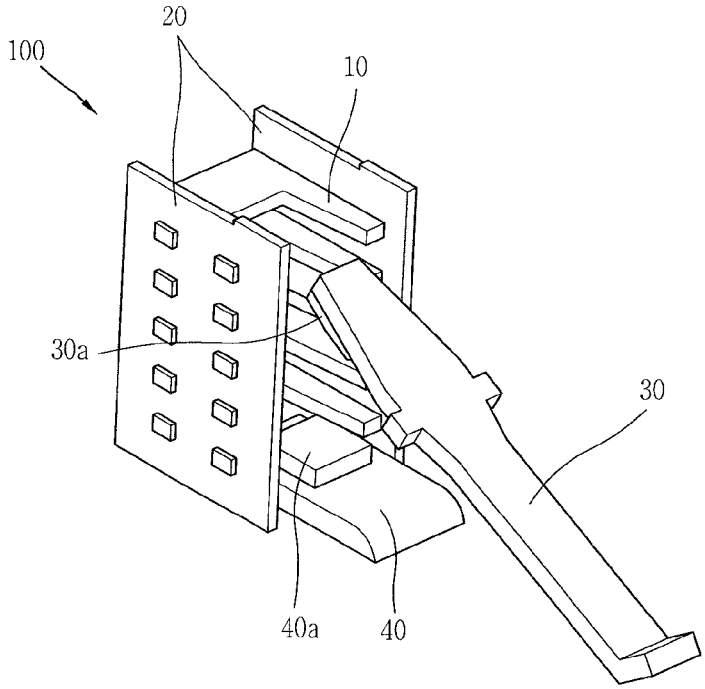
FIG. 1 RELATED ART
FIG. 1 is a perspective view showing a configuration of an arc extinguishing mechanism for a mold cased circuit breaker according to the related art.
Figure 2:
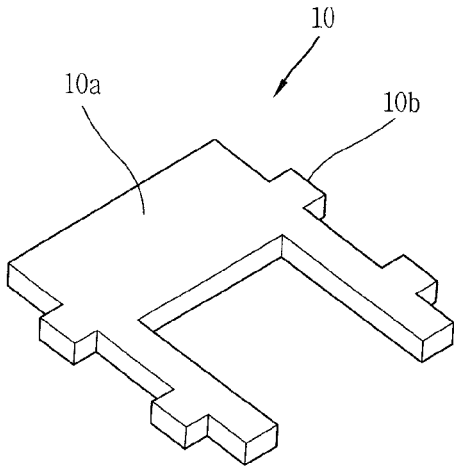
FIG. 2 RELATED ART
FIG. 2 is a perspective view showing a configuration of arc grids of the arc extinguishing mechanism for the related art mold cased circuit breaker.
Figure 3:
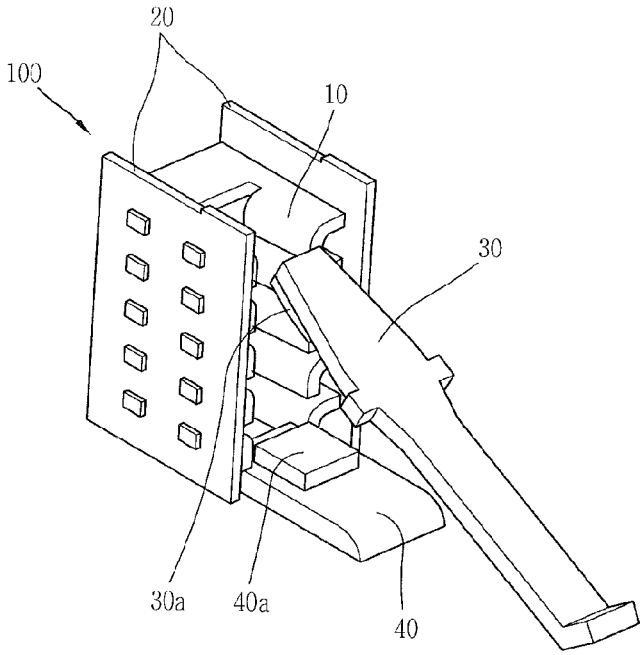
FIG. 3 is a perspective view showing a configuration of an arc extinguishing mechanism for a mold cased circuit breaker in accordance with one preferred embodiment.

The bent portion 10*d* may extend from the plate surface of the corresponding leg portion 10*c* by being perpendicularly bent. In accordance with one example, the bent portion 10*d* may extend from the plate surface of the leg portion 10*c* by being upwardly bent in the perpendicular direction. In accordance with another example, the bent portion 10*d* may extend from the plate surface of the leg portion 10*c* by being downwardly bent in the perpendicular direction. FIGS. 3 and 4 exemplarily show the downwardly extended bent portions 10*d*. Also, the bent portions 10*d* may minimize an air gap between the adjacent arc grids 10 stacked on each other, thereby increasing a force for inducing arc generated within the arc chamber toward the arc grids 10. As the air gap between the adjacent arc grids 10 is minimized, the plurality of stacked arc grids can function as a magnetic substance so as to form a strong magnetic field. Accordingly, referring to FIG. 3, the arc column, which is generated between the movable contact 30*a* and the stationary contact 40*a* within the arc grids 10, which are disposed to surround the movable contact 30*a* and the stationary contact 40*a*, can be fast induced toward the arc grids 10, which allows fast arc extinguishment.

To correspond to the protrusions 10*b* of each arc grid 10, each of the supporting plates 20 may comprise a plurality of grid insertion holes (reference numeral not given), in which the protrusions 10*b* of each arc grid 10 are inserted. FIG. 3 shows a state that the supporting protrusions 10*b* of the arc grids are inserted in the corresponding grid insertion holes.

The arc extinguishing mechanism assembly 100, referring to FIG. 3, may be installed such that the contacts 40*a* and 30*a* of the stationary contactor 40 and the movable contactor 30 are located between both the leg portions 10*c* of the U-shaped plate portion 10*a*. Hence, the stationary contact 40*a* of the stationary contactor 40 is fixed between the leg portions 10*c* of the U-shaped plate portion 10*a*, and the movable contact 30*a* of the movable contactor 30 is also located between the leg portions 10*c* of the U-shaped plate portion 10*a* to be movable to a position of contacting the stationary contact 40*a* of the stationary contactor 40 or a position of being separated from the stationary contact 40*a*.

Description will now be given of an operation effect of the arc extinguishing mechanism for the mold cased circuit breaker with reference to FIGS. 3 and 4.

The arc extinguishing mechanism for the mold cased circuit breaker was simulated, using an electromagnetic field interpretation simulation program, to check a flux flow of the arc grids 10 and Lorentz force, which is applied to an arc column by the arc grids 10 made of the ferromagnetic material in a direction toward the arc grids 10 under assumption that a direct current of 10000 A flows on the arc column.

According to the simulation results by the simulation program based on Equation (1), it can be noticed that the arc column, which is under assumption that the direct current of 10000 A flows thereon, is affected by Lorentz force of about 190 N (Newton) in a direction toward the arc grids 10.

That is, with the structure of the arc extinguishing mechanism for the mold cased circuit breaker in accordance with the one preferred embodiment, the arc column is moved toward the arc grids 10 by a force of about 190 N, which is increased by about 60% stronger than 120 N of the related art. Therefore, the arc extinguishing mechanism for the mold cased circuit breaker can remarkably reduce the arc movement time, compared with the related art, thereby further reducing the arc extinguishing time.

Also, since the arc extinguishing mechanism for the mold cased circuit breaker comprises the arc grids, each having the bent portions perpendicularly extending from the leg portions of the arc grids, an air gap between the adjacent arc grids can be minimized. Accordingly, the plurality of arc grids stacked on one another can function as a magnetic substance to form a strong magnetic field, which allows the arc column generated within the arc chamber to be fast moved to the arc grids, resulting in a fast arc extinguishment.

The foregoing embodiments and advantages are merely preferred and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the preferred embodiments described herein may be combined in various ways to obtain additional and/or alternative preferred embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An arc extinguishing mechanism for a mold cased circuit breaker comprising a plurality of arc grids stacked one-by-one perpendicular to a bottom of the arc extinguishing mechanism and supporting plates that support the arc grids in order to form an arc chamber, wherein each of the plurality of arc grids comprises:

a U-shaped plate portion made of a ferromagnetic material and comprising a pair of divided leg portions that form a rectangular gap between the pair of leg portions and a flat surface;

a plurality of supporting protrusions laterally extending from the plate portion to such that they are flush with the plate portion and allow the plate portion be installed to and supported by the supporting plates; and a pair of bent portions vertically bent and extending from the pair of divided leg portions, wherein each of the pair of bent portions is physically separated from the other of the pair of bent portions by a substantially continuous predetermined distance and a top surface of one of the pair of bent portions faces a top surface of the other of the pair of bent portions such that a force for inducing an arc generated in the arc chamber toward the plurality of arc grids is increased.

2. The mechanism of claim 1, wherein each pair of bent portions extend downward from the corresponding pair of divided leg portions and are bent downward by 90 degrees.

3. The mechanism of claim 1, wherein each pair of bent portions extend upward from the corresponding pair of divided leg portions and are bent upward by 90 degrees.

* * * * *